US007368177B2

(12) United States Patent
Quadakkers et al.

(10) Patent No.: US 7,368,177 B2
(45) Date of Patent: May 6, 2008

(54) HIGHLY OXIDATION RESISTANT COMPONENT

(75) Inventors: Willem J. Quadakkers, Wiinandsrade (NL); Werner Stamm, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 128 days.

(21) Appl. No.: 10/520,238

(22) PCT Filed: Jul. 3, 2003

(86) PCT No.: PCT/EP03/07141

§ 371 (c)(1),
(2), (4) Date: Dec. 30, 2004

(87) PCT Pub. No.: WO2004/005581

PCT Pub. Date: Jan. 15, 2004

(65) Prior Publication Data

US 2005/0238907 A1 Oct. 27, 2005

(30) Foreign Application Priority Data

Jul. 9, 2002 (EP) ..... 02015282

(51) Int. Cl.
*B32B 15/00* (2006.01)
*F04D 29/38* (2006.01)

(52) U.S. Cl. ..... 428/680; 428/678; 428/633; 428/632; 416/241 R

(58) Field of Classification Search ..... 428/679, 428/632
See application file for complete search history.

(56) References Cited

U.S. PATENT DOCUMENTS 4,615,864 A * 10/1986 Dardi et al. ..... 420/437
5,507,623 A 4/1996 Kojima et al.
5,514,482 A 5/1996 Strangman
5,792,521 A 8/1998 Wortman
6,001,492 A 12/1999 Jackson et al.
6,221,181 B1 4/2001 Bossmann et al.
6,255,001 B1 7/2001 Darolia
6,287,644 B1 9/2001 Jackson et al.
6,291,084 B1 9/2001 Darolia et al.
6,403,165 B1 6/2002 Grylls et al.
2001/0004475 A1 6/2001 Allen et al.
2002/0098294 A1* 7/2002 Lau et al. ..... 427/454
2002/0187336 A1* 12/2002 Khan et al. ..... 428/323
2005/0287296 A1* 12/2005 Wadley et al. ..... 427/248.1

FOREIGN PATENT DOCUMENTS

EP 0 718 419 A2 6/1996
EP 1 167 575 A2 1/2002
JP 09157866 A 6/1997
WO WO 99/55527 11/1999

OTHER PUBLICATIONS

Kh.G. Schmitt-Thomas, M. Hertter, "Improved Oxidation Resistance of Thermal Barrier Coatings", Surface & Coatings Technology, 1999, pp. 84-88, vol. 120-121, Elsevier Science S.A., Netherlands.

G. Müller, G. Schumacher, D. Strauβ, "Oxide Scale Growth on MCrA1Y Coatings after Pulsed Electron Beam Treatment", Surface & Coatings Technology, 1998, pp. 43-47, vol. 108-109, Elsevier Science S.A., Netherlands.

* cited by examiner

*Primary Examiner*—Jennifer McNeil
*Assistant Examiner*—Gordon R. Baldwin

(57) ABSTRACT

An oxidation resistant component is disclosed comprising a substrate and a protective layer. The protective layer consists of an inner MCrAlY layer contiguous with the substrate and an outer layer consisting of at least Ni and Al and having a β-NiAl structure

10 Claims, 1 Drawing Sheet

HIGHLY OXIDATION RESISTANT COMPONENT

CROSS REFERENCE TO RELATED APPLICATION

This application is the US National Stage of International Application No. PCT/EP2003/007141, filed Jul. 3, 2003 and claims the benefit thereof. The International Application claims the benefits of European Patent application No. 02015282.3 EP filed Jul. 9, 2002, both of the applications are incorporated by reference herein in their entirety.

FIELD OF THE INVENTION

This invention relates to a component, especially a blade or vane of a gas turbine, with a high oxidation resistance.

BACKGROUND OF THE INVENTION

Metallic components, which are exposed to high temperature must be protected against heat and corrosion.

Especially for gas turbines with its combustion chamber or its turbine blades or vanes it is common to protect the components with an intermediate, protective MCrAlY layer (M=Fe, Co, Ni), which provides oxidation resistance, and a ceramic thermal barrier coating, which protects the substrate of the metallic component against the heat.

An aluminium oxide layer is formed between the MCrAlY- and the thermal barrier coating due to oxidation.

For a long life term of a coated component it is required to have a good connection between the MCrAlY layer and the thermal barrier coating, which is provided by the bonding of the thermal barrier coating and the oxide layer onto the MCrAlY layer.

If a thermal mismatch between the two interconnecting layers prevails or if the ceramic layer has no good bonding to the aluminium oxide layer formed on the MCrAlY layer, spallation of the thermal barrier coating will occur.

From the U.S. Pat. No. 6,287,644 a continuously graded MCrAlY bond coat is known which has an continuously increasing amount of Chromium, Silicon or Zirconium with increasing distance from the underlying substrate in order to reduce the thermal mismatch between the bond coat and the thermal barrier coating by adjusting the coefficient of thermal expansion.

The U.S. Pat. No. 5,792,521 shows a multi-layered thermal barrier coating.

The U.S. Pat. No. 5,514,482 discloses a thermal barrier coating system for superalloy components which eliminates the MCrAlY layer by using an aluminide coating layer such as NiAl, which must have a sufficiently high thickness in order to obtain its desired properties. Similar is known from the U.S. Pat. No. 6,255,001.

The NiAl layer has the disadvantage, that it is very brittle which leads to early spallation of the onlaying thermal barrier coating.

The EP 1 082 216 B1 shows an MCrAlY layer having they-phase at its outer layer. But the aluminium content is high and this γ-phase of the outer layer is only obtained by re-melting or depositing from a liquid phase in an expensive way, because additional equipment is needed for the process of re-melting or coating with liquid phase.

SUMMARY OF THE INVENTION

In accordance with the foregoing is an object of the invention to describe a protective layer with a good oxidation resistance and also with a good bonding to the thermal barrier coating.

The task of the invention is solved by a protective layer which has one underlying conventional MCrAlY layer on which different compositions of MCrAlY and/or other compositions are present as an outer layer.

One possibility is that the outer layer zone has a composition chosen such that it possesses the β-NiAl-structure.

Especially the MCrAlY layer, which consists of γ-Ni solid solution, is chosen such, that the material of the MCrAlY-layer can be applied e.g. by plasma-spraying. This has the advantage that the outer layer can be deposited in the same coating equipment directly after the deposition of the inner layer (MCrAlY) without re-melting the surface in another apparatus.

The protective layer can be a continuously graded, a two layered or a multi-layered coating.

DETAILED DESCRIPTION OF THE INVENTION

The invention may be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
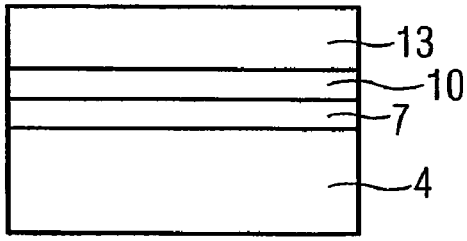
FIG. 1 shows a heat resistant component as known by state of the art.

FIG. 1 shows a heat resistant component as known by state of the art.

The highly oxidation resistant component has a substrate 4, a MCrAlY layer 7 on the substrate, on which a thermally grown oxide layer 10 (TGO) is formed or applied and finally an outer thermal barrier coating 13.

Figure 2:
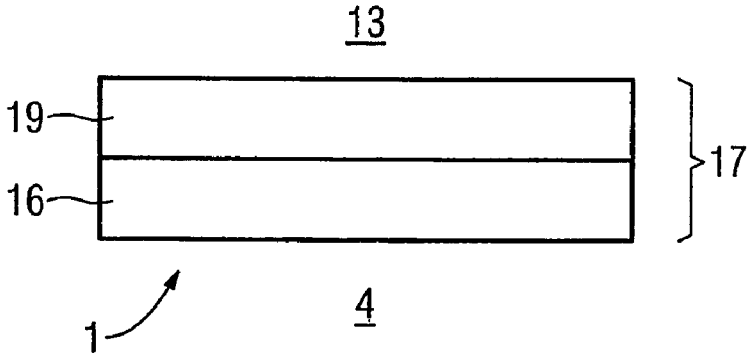
FIGS. 2, 3 shows examples of an inventive oxidation resistant component.

FIG. 2 shows an highly oxidation resistant component 1 according the invention.

The component 1 can be a part of gas turbine, especially a turbine blade or vane or heat shield.

The substrate 4 is metallic, e.g. a super alloy (Ni—Al-based, e.g.)

On the substrate 4 the MCrAlY layer zone 16 is a conventional MCrAlY layer 16 of the type e.g. NiCoCrAlY with a typical composition (in wt %) 10%-50% Cobalt (Co), 10%-40% Cromium (Cr), 6%-15% Aluminium (Al), 0.02%-0.5% Yttrium (Y) and Nickel (Ni) as base or balance.

This MCrAlY layer 16 may contain further elements such as: 0.1%-2% Silicon (Si), 0.2%-8% Tantalum (Ta), 0.2%-5% Rhenium (Re).

Instead at least a part of Yttrium or in addition this MCrAlY layer zone 16 can also contain Hafnium (Hf) and/or Zirconium (Zr) and/or Lanthanum (La) and/or Cerium (Ce) or other elements of the Lanthanide group.

The thickness of this conventional layer 16 is in the range from 100 to 500 micrometer and is applied by plasma spraying (VPS, APS) or other conventional coating methods.

In this example the inventive highly oxidation resistant component 1 reveals a MCrAlY layer 16 with another outer layer zone 19 on top, which forms together with the layer zone 16 the protective layer 17.

For example, the outer layer zone 19 consists of the phase β-NiAl. The thickness of this layer 19 is in the range between 1 and 75 micrometer, especially up to 50 micrometer.

The disadvantage of brittleness of the β-NiAl phase is overcome by the fact that the β-NiAl layer 19 is thin compared to the MCrAlY layer 16.

The outer layer 19 can solely consist of the two elements Ni and Al. The concentration of these two elements is given by the binary phase diagram Ni—Al and must be chosen in such a way that the outer layer 19 consists of pure β-NiAl phase at the temperature at which the oxidation of the layer 19, which forms the TGO 10, occurs (21-37 wt % Al or 32-50 at % Al).

Nevertheless this β-NiAl phase can contain further alloying elements as long as these elements do not destroy the phase β-NiAl phase structure. Examples of such alloying elements are chromium and/or cobalt. The maximum concentration of chromium is given by the area of the β-phase in the ternary phase diagram Ni—Al—Cr at the relevant temperatures.

Cobalt has a high solubility in the β-NiAl phase and can nearly completely replace the nickel in the NiAl-phase.

Similar further alloying elements can be chosen such as Si (Silicon), Re (Rhenium), Ta (Tantal).

The main requirement of the concentration of the alloying elements is, that it does not lead to the development of new multi-phase microstructures.

Also elements (additions) such as Hafnium, Zirconium, Lanthanum, Cerium or other elements of the Lanthanide group, which are frequently added to improve the properties of MCrAlY coatings, can be added to the β-phase layer.

The NiAl based layer is applied by plasma spraying (VPS, APS) and/or other conventional coating methods.

The advantage of the β-NiAl phase structure is that a meta-stable aluminium oxide (θ—or a mixture with γ-phase) is formed in the beginning of the oxidation of the layer 19.

The TGO (e.g. aluminium oxide layer) 10 which is formed or applied on the outer layer 19 has a desirable needle like structure and leads therefore to a good anchoring between the TGO 10 and the ceramic thermal barrier coating 13.

On conventional MCrAlY coatings, usually the stable α-phase of aluminium oxide is formed upon high temperatures exposure of the coating. However during the use of the heat resistant component 1 with its outer layer 19 metastable aluminium oxide 10 is allowed to be transformed into the stabile α-phase during high temperature exposure, which leads to a desirable microporosity in the TGO.

Another possibility of a component 1 according to the invention is given in such a way that the standard MCrAlY layer 16 is of the type NiCoCrAlY and has an amount of aluminium between 8% to 14 wt % with a thickness from 50 to 600 micrometer, especially between 100 and 300 micrometer.

On this MCrAlY layer 16 a second MCrAlY layer zone 19 of the type NiCoCrAlY is applied. The composition of this second layer is chosen in such a way that the modified MCrAlY layer 19 as outer layer 19 shows at a high application temperature (900°-1100° C.) a pure γ-Ni matrix. A suitable composition of the second layer (19) can be derived from the known phase diagrams Ni—Al, Ni—Cr, Co—Al, Co—Cr, Ni—Cr—Al, Co—Cr—Al.

Compared to conventional MCrAlY coatings this modified MCrAlY layer 19 has a lower concentration of aluminium with a concentration of aluminium between 3-6.5 wt %, which can easily be applied by plasma spraying by only changing the powder feed of the plasma spraying apparatus accordingly.

However, layer 19 can also be applied by other conventional coating methods.

A typical composition of this modified MCrAlY layer 19 which consists of γ-phase is: 15-40 wt % chromium (Cr), 5-80 wt % Cobalt (Co), 3-6.5 wt % Aluminium (Al) and Ni base, especially 20-30 wt % Cr, 10-30 wt % Co, 5-6 wt % Al and Ni base.

Instead of Yttrium this MCrAlY layer zone 19 can also contain further additions of so called reactive elements such as Hafnium (Hf) and/or Zirconium (Zr) and/or Lanthanum (La) and/or Cerium (Ce) or other elements of the Lanthanide group, which are commonly used to improve the oxidation properties of MCrAlY coatings.

The total concentration of these reactive elements may be in the range between 0.01 and 1 wt %, especially between 0.03 and 0.5 wt %.

The thickness of the modified MCrAlY layer 19 is between 1 and 80 micrometer especially between 3 and 20 micrometer.

Further alloying elements can be chosen such as Sc (Scandium), Titanium (Ti), Re (Rhenium), Ta (Tantalum), Si (Silicon).

A heat treatment prior to applying a thermal barrier coating can be carried out in an atmosphere with a low oxygen partial pressure, especially at $10^{-7}$ and $10^{-15}$ bar.

The formation of the desired meta-stable aluminium oxide on top of the modified γ-phase based MCrAlY layer 19 can be obtained by oxidation of the modified MCrAlY layer 19 at a temperature between 850° C. and 1000° C. prior to opposition of a thermal barrier coating, especially between 875° C. and 925° C. for 2-100 hours, especially between 5 and 15 hours.

The formation of these meta-stabile aluminium oxide during that mentioned oxidation process can be promoted by addition of water vapour (0.2-50 vol %, especially 20-50 vol %) in the oxidation atmosphere or by the use of an atmosphere with a very low oxygen partial pressure at a temperature between 800° C. and 1100° C., especially between 850° C. and 1050° C.

In addition to water vapour the atmosphere can also contain non-oxidizing gases such as nitrogen, argon or helium.

Because the modified MCrAlY layer 19 is thin, aluminium from the inner or standard MCrAlY layer 16 can diffuse through the modified MCrAlY layer 19 in order to support the formation of aluminium oxide on the outer surface of the layer 19 during long term service, which could not be performed by the modified MCrAlY layer 19 alone because of its low concentration of aluminium.

FIG. 2 shows a two layered protective layer 17.

Figure 3:
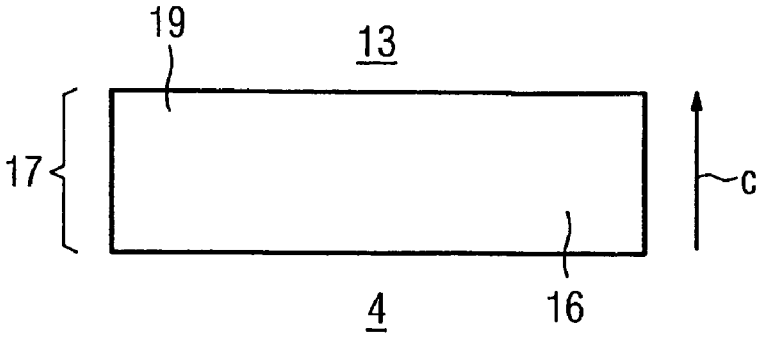

FIG. 3 shows a component with a high oxidation resistance according to the invention.

The concentration c of the MCrAlY layer 16 is continuously graded in such a way, that near the substrate 4 the composition of the MCrAlY layer 16 is given by a standard MCrAlY layer 16 as described in FIG. 2 or 1, and that near the thermal barrier coating 13 the composition of the outer layer 19 shows the composition of the layer 19 as described in FIG. 2.

On the outer layer zone (19) a thermal barrier coating (TBC) (13) is applied. Due to the good oxidation resistance of the protective layer (17) and the good bonding of the TBC to the TGO (10) due to adjustment of structure, phases and microstructure the life term of the component 1 is prolonged.

The invention claimed is:

1. An oxidation resistant component, comprising:

a substrate; and a protective layer, comprising:

an intermediate MCrAlY layer zone near the substrate wherein M is at least one element selected from the group consisting of Co, Fe, and Ni;

an outer layer zone arranged on the intermediate MCrAlY layer zone and comprising the elements Al in the range of 21 wt % to 37 wt %, Ni, 0.2 wt %-5wt % Re, at least one element selected from the group consisting of Chromium and Cobalt, and the outer layer zone consisting of a structure of the phase β-NiAl; and wherein the outer layer zone has a thickness in the range of approximately 1 micron to 50 microns, wherein the thickness is thinner than the intermediate MCrAlY layer zone.

2. The oxidation resistant component according to claim 1, wherein the protective layer consists of two separated layers.

3. The oxidation resistant component according to claim 1, wherein the component is a turbine component having application in a gas turbine.

4. The oxidation resistant component according to claim 1, the protective layer comprising a continuously graded concentration of the composition of the intermediate and outer layer zones.

5. The oxidation resistant component according to claim 1, wherein Ce is added to the outer layer zone in an amount of about 1 wt %.

6. The oxidation resistant component according to claim 1, wherein a thermal baffler coating is formed on the outer layer zone, the outer layer zone further comprising a concentration of Sc in the range of 0.01 and 1.0 wt %.

7. The oxidation resistant component according to claim 6, wherein a heat treatment prior to applying the thermal barrier coating is accomplished in an atmosphere with a low oxygen partial pressure in the range of $10^{-7}$ to $10^{-15}$ bar.

8. An oxidation resistant turbine component in a combustion turbine, comprising:

a substrate; and a protective layer, comprising:

an intermediate MCrAlY layer zone near the substrate wherein M is an element selected from the group consisting of Co, Fe, and Ni, the intermediate MCrAlY layer comprising an amount of Al in the range of about 8% to 14 wt %;

an outer layer zone arranged on the intermediate MCrAlY layer zone and comprising the elements Al in the range of 3% to 6.5 wt %, Ni, Chromium, and Cobalt and having the structure of a γ-Ni matrix; and the outer layer zone further comprising a concentration of Sc in the range of 0.01 and 1.0 wt %.

9. The oxidation resistant component according to claim 8, wherein the outer layer zone comprises 20% to 30% Cr, 10% to 30% Co, 5% to 6% Al and a Ni base and wherein the outer layer zone has a thickness of between about 3 and 20 micrometers.

10. The oxidation resistant component according to claim 8, wherein the outer layer zone further comprises Ce substituted for Y in a concentration in the range of about 0.01 to 1 wt %.

* * * * *